US006605888B1

(12) United States Patent
Waymouth et al.

(10) Patent No.: US 6,605,888 B1
(45) Date of Patent: Aug. 12, 2003

(54) METAL HALIDE LAMP WITH ENHANCED RED EMISSION, IN EXCESS OF A BLACKBODY

(75) Inventors: John F. Waymouth, Marblehead, MA (US); Timothy Lee Kelly, Boston, MA (US); Stefaan Maria Lambrechts, Beverly Farms, MA (US); Jakob Maya, Brookline, MA (US)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/427,305

(22) Filed: Oct. 26, 1999

(51) Int. Cl.[7] ..... H01J 5/16

(52) U.S. Cl. ..... 313/112; 313/110; 359/359

(58) Field of Search ..... 313/112, 110, 313/25; 359/359

*Primary Examiner*—Vip Patel

(57) ABSTRACT

A metal halide lamp having excess amount of red radiation, well beyond a tungsten halogen lamp of the same color temperature. The deep saturated red being accomplished with reasonable efficacy utilizing a mixture of sodium and rare earth halides, additional broadening of the Na "D" lines and filtering out the yellow radiation at about 590 nm. The red radiation is comparable to the commercially available white high pressure sodium lamp red radiation.

9 Claims, 4 Drawing Sheets

METAL HALIDE LAMP WITH ENHANCED RED EMISSION, IN EXCESS OF A BLACKBODY

TECHNICAL FIELD

This invention relates to ceramic and quartz metal halide lamps and more particularly to such lamps having a red emission larger than the one of tungsten halogen sources of the same color temperature. Furthermore, the red color index R9 of these lamps exceeds by a substantial amount the R9 index of the conventional metal halide lamps. Lamps with enhanced red emission and improved color rendering are highly desirable in color critical applications.

BACKGROUND OF THE INVENTION

The color rendering properties of lamps are expressed in terms of a single index, Ra. This index can be accompanied by 14 special indices which represent the color rendering properties of the specific test colors from CIE Publication 13.2 (1974). The R9 index is the red color rendering index for strong red with Munsell notation 4.5 R 4/13. One of the important advances that can be made toward the rendering of colors of metal halide lamps is to improve the red color rendering. Quartz metal halide lamps with a sodium-scandium-lithium chemistry have in general an Ra of about 75 and an R9 of about −65. Ceramic metal halide lamps with a sodium-rare earth chemistry can have a general index Ra greater than 85 and a special index R9 less than −15. With reference to a blackbody source of the same color temperature, the radiation of quartz and ceramic metal halide lamps in the red region of the spectrum is much lower. A blackbody source has a peak radiation in the infrared region and has much better red color rendering. The R9 index of a blackbody source is 100 (see FIG. 4 for nomenclature).

To improve the red color rendering, conventional metal halide lamps in color critical applications such as clothing retailing are combined with discharge lamps having excessive red radiation. The lamps with enhanced red emission can be of the type of white high pressure sodium lamps. Their amount of red exceeds the red radiation of the corresponding blackbody source of the same color temperature. This combination of the two different types of lamps is expensive and requires additional space for mounting.

PRIOR ART

W. Thornton (U.S. Pat. No. 4,029,983; 1977) introduced a metal halide lamp having a light output with incandescent characteristics. The quartz metal halide lamp employs a sodium-scandium discharge and a luminescent coating on the inner surface of the outer envelope. The coating comprises a blend of green emitting CaS:Ce phosphor and a red emitting CaS:Eu phosphor. The color temperature of the sodium-scandium arc discharge is 3500K to 3900K. E. F. Wyner (Journal of IES/July 1984) also improved the red radiation of quartz metal halide lamps by means of a phosphor coating. The red emission was achieved with yttrium vanadate and magnesium fluorogermanate phosphor coatings. The phosphors are activated by the ultraviolet radiation of the lamp. The color temperature averaged about 3000K through the life of the lamp. Caruso et al. (U.S. Pat. No. 4,742,268; 1988) invented a high color rendering calcium-containing metal halide lamp. The long-arc ellipsoidal arc tube provided a high cold spot temperature and an exceptional color rendition. Kramer et al. (U.S. Pat. No. 4,801,846; 1989) invented a rare earth halide light source with enhanced red emission. High efficacy, good color rendering, and a warm color temperature were attained by utilizing rare earth fills in conjunction with calcium halides and, or sodium halides. Ramaiah et al (U.S. Pat. No. 5,225,738; 1993) disclosed a metal halide lamp with improved lumen output and color rendering. The color temperature of the lamp containing sodium and scandium iodide was decreased to below about 3635K by the addition of critical amounts of thallium iodide and lithium iodide. The general Ra index was greater than about 75, however, the special rendering index R9 had a low negative value of −65 resulting in poor red color rendering. Krasko et al. (U.S. Pat. No. 5,694,002; 1997) described a new metal halide lamp with improved color characteristics. The CRI improved from 75 to 85 and the special index R9 increased from −65 to −15. The fill composition included the halides of sodium, scandium, lithium, dysprosium and thallium.

SUMMARY OF THE INVENTION

The present invention utilizes an unique construction to enhance the red emission and to improve the red color rendering. For a quartz or ceramic metal halide lamp, the radiant energy in the yellow region of the spectrum is reduced or filtered out at about 589 nm. In addition, the radiant energy in the red region is enhanced by increasing the salt vapor pressure and consequently by broadening the sodium D-line. The lamps with such a construction have enhanced red emission, well beyond the red amount in a blackbody source of the same color temperature. Furthermore, the special index R9 increases from −20 to about 55 (see FIG. 4).

The increase in the salt vapor pressure is most conveniently obtained by using heat shields made out of metal as described by Zhu et al. (Application Ser. No. 09/074623) and assigned to the same assignee as the present application. Alternatively, increased vapor pressure of the salts can be accomplished by increased wall loading. For ceramic arc tubes, one can safely go to about 3OW/cm$^2$, while for quartz arc tubes, one probably should not exceed about 24W/cm$^2$ so maintenance and life are not adversely affected. The increased vapor pressure leads to broadening of the Na "D" line which enhances the red and green emissions while the yellow around 590 nm is self-reversed somewhat. Subsequently, this radiation is subjected to a filter which filters out further the yellow around 590 mn resulting in purely enhanced red radiation. This leads to a somewhat reduced efficacy due to the removal of the yellow radiation. The particular characteristics of the broadening of the "D" lines and the filtering will be explained hereinafter.

BRIEF DESCRIPTION OF THE TABLES AND DRAWINGS

TABLE 1 shows the performance characteristics of a standard metal halide lamp, a white high pressure sodium lamp and the present invention.

DETAILED DESCRIPTION OF THE PREFERRED EMBODIMENT

Figure 1:
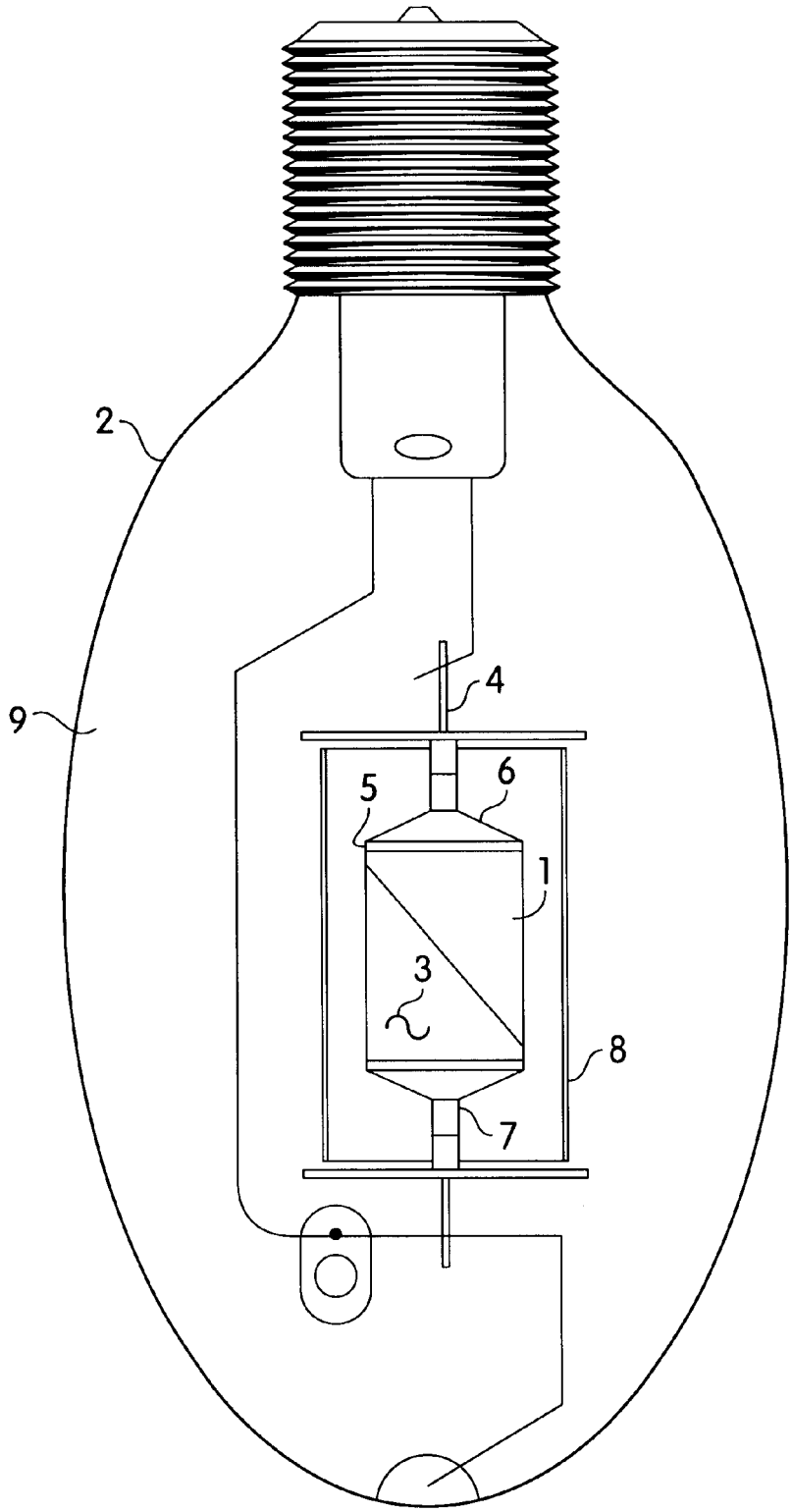
FIG. 1 shows the construction of the lamp of this invention.

As shown in FIG. 1, the arc tube 1 is made of polycrystalline alumina (PCA) and is housed in an outer jacket 2 of hard glass. The outer jacket volume 9 may be evacuated or filled with an inert gas such as 350 Torr of nitrogen. The arc tube is dosed with the halides 3 of sodium, thallium, lithium, dysprosium, thullium and holmium. The lamp current is conducted by means of feed through assemblies 4 that are hermetically sealed to the alumina arc tube. Heat shields 5 are mounted on the ends of the alumina arc tube. The shields may be made out of metals such as molybdenum, nickel, niobium, kovar, etc. and they are described in Huiling et al. application Ser. No. 09/074,623. Molybdenum heat shields with a thickness of 0.1 mm work very well. They are crimped onto the conic part 6 of the arc tube. Furthermore, 0.1 mm thick molybdenum skirts of 3 mm length were attached to the capillary part 7 of the arc tube. The metal heat shields raise the cold spot temperature and the salt vapor pressure in the arc tube. Consequently, the spectral broadening and the self reversal-width of the sodium D-line are increased proportionally. The shroud 8 is made of filter glass and has an absorption band at about 589 mn with a bandwidth of 30 nm. The transmission is reduced to about 20% at 589 nm. The filter glass is a simple method to reduce the yellow radiation. The filter may be an absorption or a reflection filter and may be applied on the glass shroud or on the glass outer jacket. Another way to reduce the yellow radiation is to use an absorbing glass with a dopant such as neodymium-cerium.

Figure 2:
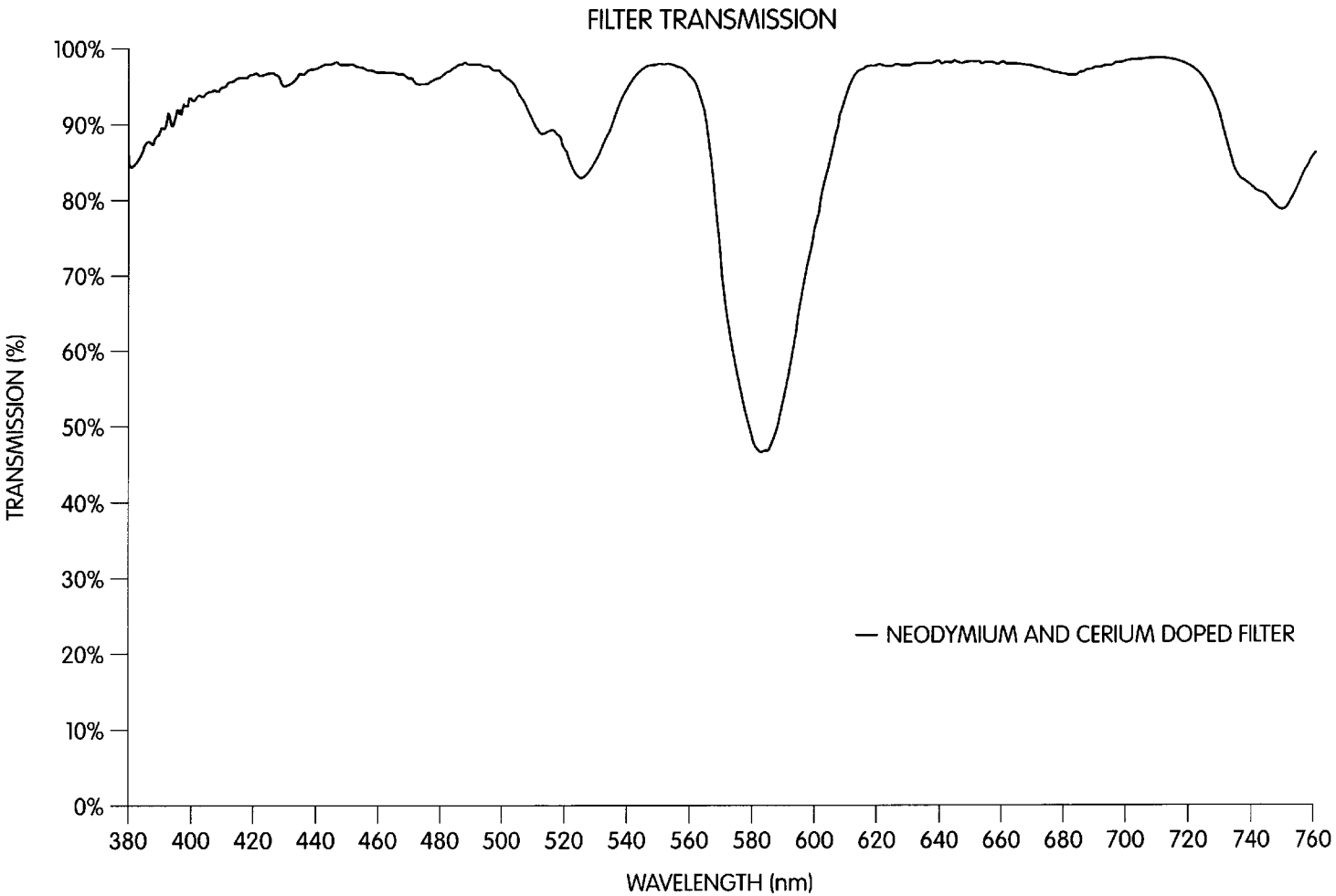
FIG. 2 shows the spectral transmittance of a 1.5 mm thick neodymium and cerium doped Vycor shroud.

FIG. 2 shows the spectral transmittance of a neodymium-cerium glass filter. There are many additional ways of filtering out some portion of the yellow radiation which may turn out to be more convenient, less laborious or less expensive dependent on the particular manufacturing process chosen. For example a chemical dip coating technique has been found to be quite economical in the lighting industry for many applications. This dip coating could be applied to the shroud which already exists in many low wattage metal halide lamps. Similarly, a well known sol-gel technique in which a chemical. synthesis of oxides involving hydrolyzable alkoxides that undergo a sol-gel transition could be applied to the shroud to accomplish the same goal. Yet a more expensive but far more precise technique is the application of a multilayer thin film to obtain a precise definition of the transmission of the film. While this technique gives precise and reproducible filtering properties, it tends to be more expensive in manufacturing.

As is well known in the lighting and paint industries, the dip coating is inexpensive and quite effective. In this technique an appropriate selection of chemicals are mixed with a binder, such as ethyl alcohol, to obtain a slurry. The chemicals are selected according to their light absorption properties which are commonly known. After the slurry is prepared, the piece to be coated is dipped into the liquid (hence dip coating) and baked to evaporate the binder, leaving behind a film of the desired chemicals.

Multilayer thin film processing is a more laborious, sophisticated and expensive process. A variety of chemicals are either are evaporated, sputtered or chemically recombined onto the surface. Usually one simulates the process on a computer and determines how many layers are needed to obtain the necessary absorption and transmission properties. The process is then conducted in vacuum chambers.

Figure 3:
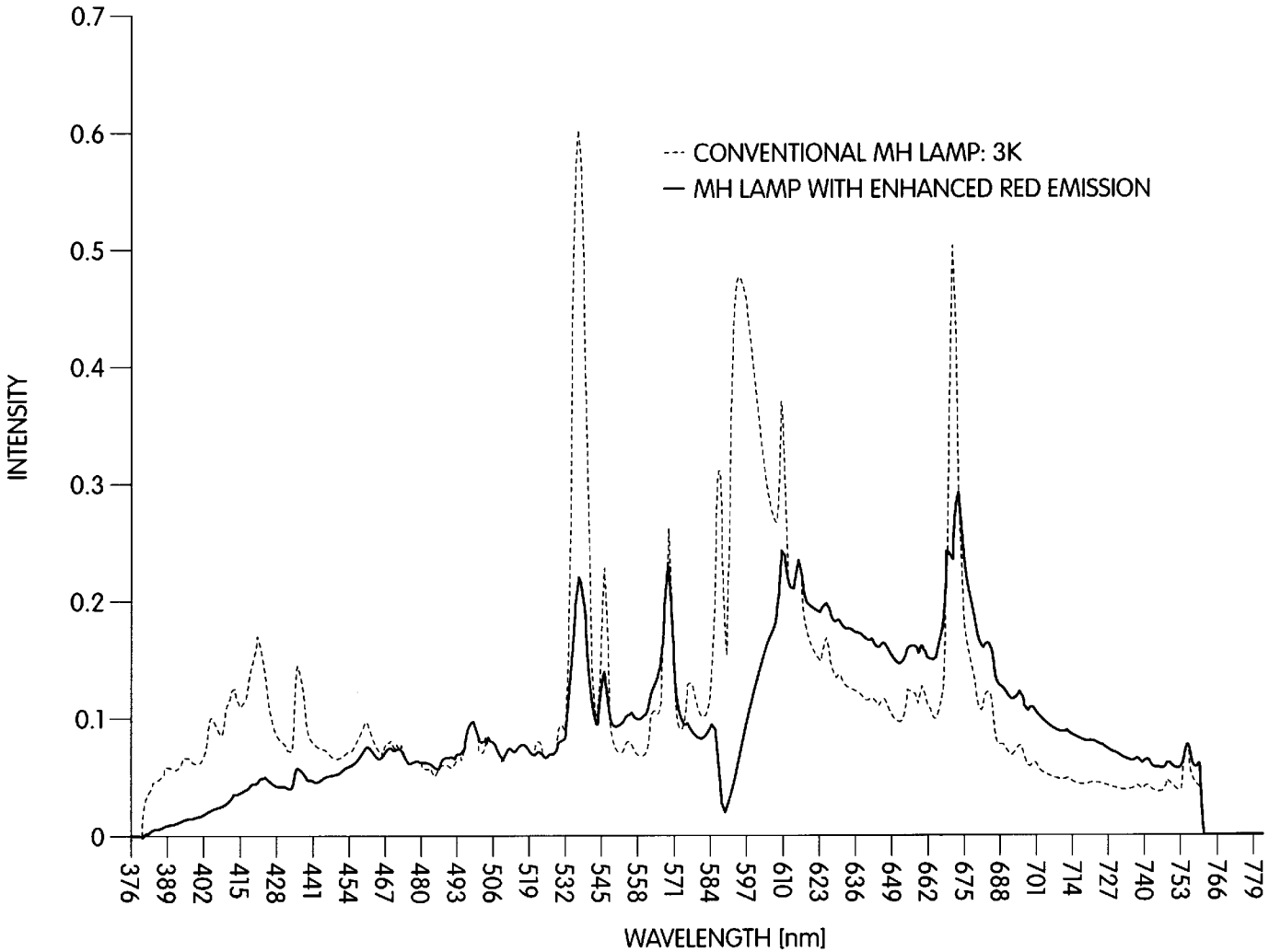
FIG. 3 shows the spectral distribution of the radiant energy of a conventional metal halide lamp and a metal halide lamp with enhanced red radiation.

FIG. 3 shows the spectral distribution of the radiant energy of a conventional metal halide lamp and a metal halide lamp with enhanced red radiation. The energy spectrum from 380 to 780 nm was measured in an integrating sphere with a spectrometer from Princeton Instruments, Inc. The lamp was aged for 100 hours at 150W with an electronic ballast, type MHR 1501CK-2E from National. In this particular case, the lamp was burned in a vertical base-up position. However, other burning positions such as vertical base-down and horizontal can be done. One can see the spectral broadening of the sodium D-line radiation due to the increase of the sodium vapor pressure. The right and the left sodium wings extend out to the longer and the shorter wavelengths, respectively. At 589 nm, the sodium D-line is self-reversed due to the high sodium vapor pressure. The radiation at 589 mn is further absorbed by the filter glass of the shroud. The spectral broadening of the sodium D-line and the absorption at 589 nm increase the special R9 index, resulting in enhanced red rendering. In Table 1, we present the performance characteristics of the standard 150W ceramic metal halide lamp (made by Matsushita Electric Corporation, Osaka, Japan and sold under the brand name Panabeam), the performance of the present invention which uses the same chemistry, ceramic arc tube and construction of the Panabeam mentioned above and also for comparison purposes a white HPS lamp, having very high pressure of sodium and excessive red radiation.

As can be seen, the efficacy of the present invention is reduced somewhat compared to the standard lamp. This is due primarily to the elimination of the yellow radiation as mentioned above. However, notice the red index is substantially improved and is well beyond the red index of the standard metal halide lamp. The overall CRI is maintained at a high value of 87 and the $D_{uv}$ (a measure of deviation from the blackbody curve times 1000) is only 4.2 which is very close to the blackbody. We should note that extensive maintenance and life test measurements have indicated there are no adverse effects due to the heat shields on the ceramic metal halide arc tubes. This has been verified as well in conjunction with the Zhu et al application Ser. No. 09/074623 mentioned above. It is also notable that lamps currently used for red enhancement are very high pressure sodium lamps at CCT of about 2800K that typically have efficacies of 30–50 lpw. Furthermore, these lamps take a very long time to warm up (15 min.) and require very cumbersome gear to operate. The red enhanced metal halide lamp of the present invention warms up very quickly (~2 min.), utilizes the same compact low wattage metal halide lamp and has a higher efficacy than the very high pressure white HPS lamp.

| | Ceramic Metal Halide* | White HPS HICA** | Present Invention |
|---|---|---|---|
| Power (W) | 150 | 150 | 150 |
| Efficacy (lpw) | 88 | 40 | 64 |
| CCT(K) | 2942 | 2800 | 3094 |
| Ra | 84 | 85 | 87 |
| R9**** | −20 | $-20^{+}$ | $+55^{+}$ |
| Red Content*** | −20 | −220 | −155 |
| Duv | 4.9 | 2.0 | 4.2 |
| Warm Up Time (min.) | −3 | −15 | −1.5 |

Figure 4:
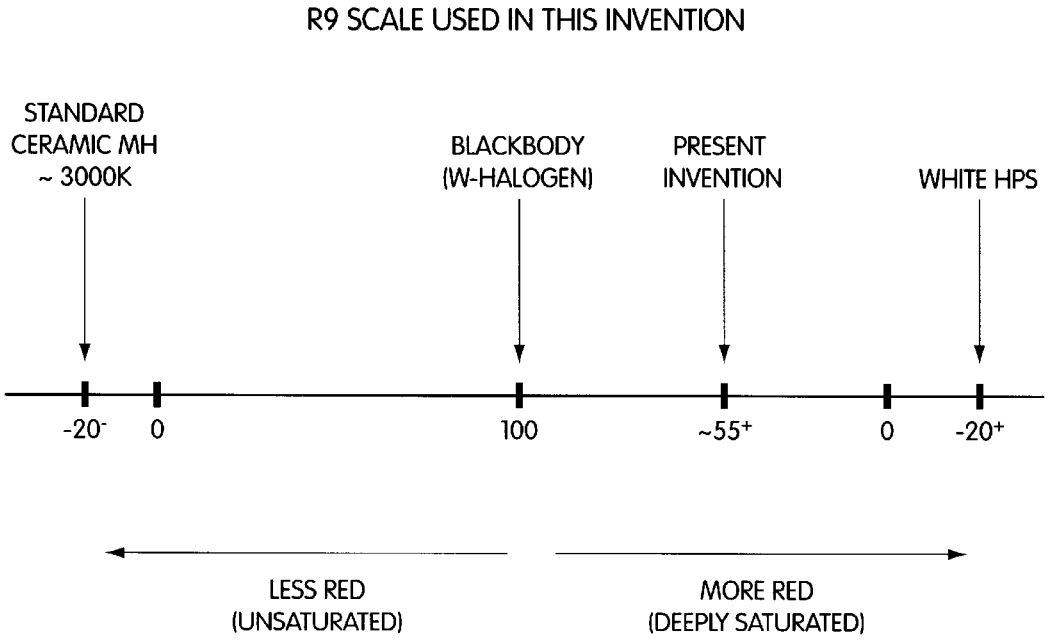
FIG. 4 shows the R9 nomenclature and scale used in this invention.

*Panabeam made by Matsushita Electric Corporation
**HICA made by Matsushita Electric Corporation
***In this linear scale, the tungsten halogen source is used as a reference with a value of 100
****The superscript (−) or (+) is used to denote deficiency of red (−) or excess (+) [see FIG. 4] as compared to a tungsten halogen (blackbody) reference of the same CCT.

It is apparent that modifications can be made within the spirit and scope of the present application, but it is our intention, however, only to be limited by the scope of the following claims.

As our invention we claim:

1. A high pressure electric discharge lamp comprising:

an arc tube with an electrode sealed at each end thereof and filled with a mixture of metal halides, mercury and a rare gas;

a heat shield attached to each of ends of said arc tube to raise the cold spot temperature and the salt vapor pressure in the arc tube; and means to filter radiation centered around 590 nm disposed around said arc tube to filter radiation centered around 590 nm, said means having a full width centered around 590 nm that varies between 10 nm and 100 nm; and an outer jacket disposed around said arc tube and said filter means and a current conveying means provided to carry appropriate current to said electrodes.

2. The lamp according to claim 1 wherein the arc tube is made of either polycrystalline alumina or quartz.

3. A The lamp according to claim 1 where the metal halides are one or more of sodium iodide, lithium iodide, thallium iodide, indium iodide, and a rare earth halide.

4. The lamp according to claim 1 wherein the filter means is a glass shroud doped with Nd and Ce.

5. The lamp according to claim 1 where the filter means is a multilayer thin film on the arc tube itself.

6. The lamp according to claim 1 where the filter means is a dip coated chemical film on the arc tube, the outer jacket or an external shroud surrounding the arc tube.

7. The lamp according to claim 1 where the filter means is a deposited layer which filters emissions centered around 590 nm on a shroud surrounding the arc tube utilizing a sol-gel technique.

8. A high pressure lamp comprising:

a ceramic arc tube with an electrode at each end thereof, said tube being filled with a mixture including excess metal halides, mercury and rare gas, the radiation of said lamp being white and close to the blackbody, the wall loading of said tube being increased from a customary of 22W/cm$^2$ to about 30W/cm$^2$ to increase the broadening of the sodium "D" lines; and filter means with said arc tube to filter out radiation centered around 590 nm, said filter means having a filter width with a full width at half maximum that varies between 10 nm and 100 nm.

9. The lamp according to claim 8 where the arc tube is made of quartz and where the power loading has been increased from a customary of 14–20W/cm$^2$ to about 24W/cm$^2$.

* * * * *